US007537808B2

(12) United States Patent
Goto et al.

(10) Patent No.: US 7,537,808 B2
(45) Date of Patent: May 26, 2009

(54) ELECTRODE FOR ELECTRIC DISCHARGE SURFACE TREATMENT, ELECTRIC DISCHARGE SURFACE TREATMENT METHOD AND ELECTRIC DISCHARGE SURFACE TREATMENT APPARATUS

(75) Inventors: Akihiro Goto, Tokyo (JP); Masao Akiyoshi, Tokyo (JP); Hiroyuki Ochiai, Saitama (JP); Mitsutoshi Watanabe, Tokyo (JP)

(73) Assignees: Mitsubishi Denki Kabushiki Kaisha, Tokyo (JP); Ishikawajima-Harima Heavy Industries Co., Ltd., Tokyo (JP)

( * ) Notice: Subject to any disclaimer, the term of this patent is extended or adjusted under 35 U.S.C. 154(b) by 714 days.

(21) Appl. No.: 10/516,506

(22) PCT Filed: Jul. 30, 2003

(86) PCT No.: PCT/JP03/09687

§ 371 (c)(1),
(2), (4) Date: Dec. 1, 2004

(87) PCT Pub. No.: WO2004/011696

PCT Pub. Date: Feb. 5, 2004

(65) Prior Publication Data

US 2005/0211165 A1 Sep. 29, 2005

(30) Foreign Application Priority Data

Jul. 30, 2002 (JP) ..... 2002-220971

(51) Int. Cl.
*B05D 1/04* (2006.01)
*B05C 5/00* (2006.01)
*H05F 3/00* (2006.01)

(52) U.S. Cl. ..... 427/580; 118/620; 204/164

(58) Field of Classification Search ..... 427/580
See application file for complete search history.

(56) References Cited

U.S. PATENT DOCUMENTS 5,858,479 A 1/1999 Saito et al.

(Continued)

FOREIGN PATENT DOCUMENTS

EP 0338574 A1 10/1989

(Continued)

OTHER PUBLICATIONS

Goto Akihiro, et al./ "Forming thick coat by Electric Discharge Surface Treatment (EDC)" Mold Technique, Nikkan Kougyou Shinbusha.

(Continued)

*Primary Examiner*—Frederick J Parker
(74) *Attorney, Agent, or Firm*—Sughrue Mion, PLLC

(57) ABSTRACT

A method, apparatus, and electrode for electric discharge surface treatment. The electrode is a green compact made by molding metallic powers or metallic compound powders, the green compact being heat treated and used for electric discharge surface treatment in which a pulsed electric discharge is generated between the electrode and a work in a dielectric fluid to form by the electric discharge energy on the surface of the work a coat of a material of the electrode or of a substance that is generated by a reaction of the electrode due to the electric discharge energy, wherein the electrode contains 40 volume % or more Co, Ni, or Fe. Thereby, a thick coat is formed by the in-liquid pulsed electric discharge treatment.

19 Claims, 14 Drawing Sheets

U.S. PATENT DOCUMENTS

| | | | | |
|---|---|---|---|---|
| 6,602,561 | B1 * | 8/2003 | Moro et al. | 427/580 |
| 2005/0211165 | A1 | 9/2005 | Goto et al. | |

FOREIGN PATENT DOCUMENTS

| | | | |
|---|---|---|---|
| EP | 0548932 | A1 | 6/1993 |
| EP | 1 035 231 | A1 | 9/2000 |
| JP | 5-148615 | A | 6/1993 |
| JP | 06-182626 | * | 7/1994 |
| JP | 07-070761 | A | 3/1995 |
| JP | 7-70761 | A | 3/1995 |
| JP | 07-197275 | | 8/1995 |
| JP | 07-197275 | A | 8/1995 |
| JP | 8-300227 | A | 11/1996 |
| JP | 3271844 | B | 7/1997 |
| JP | 11-000827 | A | 6/1999 |
| JP | 9-192937 | A | 7/1999 |
| JP | 11-22915 | | 8/1999 |
| JP | 11-264080 | A | 9/1999 |
| JP | 3093846 | B2 | 7/2000 |
| JP | 3098654 | B2 | 8/2000 |
| JP | 2000-345367 | | 12/2000 |
| JP | 2001-138141 | A | 5/2001 |
| JP | 3227454 | B1 | 8/2001 |
| JP | 2002-20882 | A | 1/2002 |
| JP | 3271836 | B2 | 1/2002 |
| JP | 2002-370127 | | 12/2002 |
| WO | 99/58744 | A1 | 11/1999 |
| WO | WO 99/58744 | | 11/1999 |
| WO | WO 00/50194 | A1 | 8/2000 |
| WO | WO 01/05545 | A1 | 1/2001 |
| WO | WO 01/23640 | A1 | 4/2001 |
| WO | WO 01/23641 | A1 | 4/2001 |
| WO | WO 01/24961 | A1 | 4/2001 |

OTHER PUBLICATIONS

Canadian Office Action dated Feb. 6, 2008.
European Search Report dated Aug. 22, 2008.
Formation of hard layer on metallic material by EDM Akihiro Goto et al. Pro International Symposium for Electro-machining (ISEM 12).
Development of Electrical Discharge Coating Method akihiro Goto et al. Pro International Symposium for Electro-machining (ISEM 13).
Supplemental European Search Report dated Oct. 7, 2008.

* cited by examiner

ELECTRODE FOR ELECTRIC DISCHARGE SURFACE TREATMENT, ELECTRIC DISCHARGE SURFACE TREATMENT METHOD AND ELECTRIC DISCHARGE SURFACE TREATMENT APPARATUS

TECHNICAL FIELD

The present invention relates to an electrode for electric discharge surface treatment, a method of electric discharge surface treatment, and an apparatus for electric discharge surface treatment. The electrode is a green compact and the like formed by compression molding metal powders, metal compound powders, or ceramic powders. A pulsed electric discharge is generated between the electrode and a work, and, a coat of the material of the electrode is formed on the surface of the work, or a coat of a substance that is generated by a reaction due to the electric discharge energy of the material of the electrode is formed on the surface of the work using the energy of the discharge.

BACKGROUND ART

A technique for improving corrosion resistance and abrasion resistance of a metallic material by coating the surface of the metallic material by means of an in-liquid electric discharge machining has been known. One such technique is described below.

For example, the following method is disclosed (refer to the patent literature 1). In the method, an electrode formed by compression molding a mixture of WC (tungsten carbide) powder and Co powder is used to deposit the material of the electrode on the work by in-liquid pulsed electric discharge, then a re-melting discharge machining is carried out using another electrode (for example, a copper electrode or a graphite electrode) to obtain a film with higher hardness and higher adhesion. In other words, WC—Co is deposited on the work (base metal S50C that is a kind of steel prescribed by Japanese Industrial Standard JIS G 4051) using an electrode of a green compact mixture of WC—Co by performing the in-liquid discharge machining (primary machining), subsequently re-melting machining (secondary machining) is performed using an electrode, such as copper electrode, that is not consumed very rapidly. As a result, the deposited structure had a low hardness (Vickers hardness Hv) of about Hv=1410 and there were a lot of voids at the end of the primary machining; however, the voids in the coat disappeared and the hardness improved to Hv=1750 after the re-melting machining was performed as the secondary machining. Thus, a hard coat with strong adhesion to the work, which is steel, can be obtained when the above-mentioned method is used.

However, with the above-mentioned method, it is difficult to form a coat having strong adhesion to the surface of the sintered material such as cemented carbide as a work. In this connection, it was confirmed in the research performed by the inventors of the present invention that it was possible to form a sturdy hard coat on the surface of the metallic work without performing the step of re-melting, if an electric discharge is generated between the work and an electrode of such material as Ti that forms hard carbide. The sturdy hard coat is formed due to the generation of TiC as a result of reaction between the material of the electrode, which is attrited by electric discharge, and carbon C that is a component of the dielectric fluid.

Further, a technique is disclosed in which an electric discharge is generated between an electrode of green compact metallic hydride such as $TiH_2$ (Titanium Hydride) and a work to form more speedily a hard coat having higher adhesion than when a material such as Ti is used (refer to the patent literature 2). Further, a technique is disclosed to speedily form a hard coat having various characteristics such as high hardness and high abrasion resistance by generating an electric discharge between a work and an electrode of green compact composed of hydride such as $TiH_2$ (Titanium Hydride) with which different metal or ceramic are mixed.

Moreover, there is a disclosure of another technique that teaches that it is possible to produce a sturdier electrode only by performing a preliminary sintering (refer to the patent literature 3). Namely, in manufacturing of an electrode composed of a mixture of WC powder and Co powder, the green compact may be manufactured by merely mixing WC powder with Co powder and by compression molding; however, if the compression molding is performed after wax is added to the powders, compression molding the green compact becomes easier and more efficient. However, when the wax is added and if a large amount of the wax remains in the electrode, the electric resistance of the electrode increases because the wax is dielectric, resulting in a poor electric discharge performance. Therefore, the wax is removed from the electrode by heating the green compact electrode in a vacuum furnace. In removing the wax, it is necessary to keep the heating temperature higher than the melting point of the wax and lower than the temperature at which the wax decomposes and turns into soot; because the wax will not get removed from the electrode if the heating temperature is too low, and the purity of the electrode degrades if the wax turns into soot because the heating temperature is too high. Further, the green compact in the vacuum furnace is heated by a high-frequency coil and the like so that the green compact has enough strength so as to withstand machining while preventing the green compact from becoming too hard (this is called a preliminary sintering state), in other words, the green compact is heated until the compact becomes as hard as, for example, a chalk. Bonding among the carbides at the contact parts proceeds interactively, in the preliminary sintering state; however, bonding strength is weak because the sintering temperature is lower than the temperature required for the standard sintering. It is found that it is possible to form a closely-packed homogeneous coat if the electric discharge surface treatment is performed using the electrode obtained in this manner.

Each of the above-mentioned conventional art has features in hardness and adhesion of the coat, abrasion resistance and swiftness of forming the coat, and, density and homogeneity of the coat; however, with regard to the thickness of the coat, no conventional art is sufficient, thus leaving scope for improvement.

So called welding and thermal spray coating are known as general techniques to build up a thick coat. Welding (refers to a build up welding here) is a technique of letting the material of the welding rod melt and adhere to the work by an electric discharge between the work and the welding rod. The thermal spray coating is a technique of melting the metallic material and spraying the melted material onto the work to form a coat. Since either method is a manual labor requiring skills, which makes it difficult to establish a continuous production line, the both methods have a drawback of having a high production cost. Moreover, especially as welding is a method in which heat enters the work convergently, when dealing which thin materials or brittle materials such as single crystal alloy and directional control alloy such as unidirectionally solidified alloy, cracks are easily produced and lower the yield.

The Patent Literature 1
Japanese Patent Application Laid-Open No. H5-148615

The Patent Literature 2
Japanese Patent Application Laid-Open No. H9-192937

The Patent Literature 3
Japanese Patent No. 3227454

Non-Patent Literature 1
"Formation of Thick Layer by Electrical Discharge Coating (EDC)", Goto Akihiro et al., Mold Technique, (1999), Nikkan Kougyou Shinbunsha.

The emphasis has been placed on forming a hard coat in the conventional electric discharge surface treatments; therefore, the main materials of the electrode are hard ceramic materials or the material that forms hard carbide by a chemical reaction with C (carbon) that is a component of the oil in the dielectric fluid, due to the electric discharge energy. However, hard materials generally have a high melting point and a low heat conductivity characteristic. Therefore, although it is possible to obtain a closely packed coat of a thickness of the order of 10 micrometers (μm), it is very difficult to obtain a closely packed coat of a few 100 μm or thicker.

Although it is described in the literature (see non-patent literature 1) based on a study by the inventors of the present invention that about a 3-millimeter-thick coat was obtained using an electrode of WC—Co (9:1), the technique described is difficult to put into practical use, because it has such problems as reproduction is difficult due to unstable coat formation, the coat is brittle having a lot of voids, and the coat is so weak as that it is removed if scraped with a piece of metal even though the coat apparently has metallic luster and looks closely packed.

Further, regarding the above-described welding and the thermal spray coating to build up the coat, both the techniques have problems because they require a lot of manual work which results in higher production cost because of difficulty in building a line production plant, and lower yield because of generation of welding cracks.

It is an object of the present invention to provide an electrode for electric discharge surface treatment, a method of electric discharge surface treatment, and an apparatus for electric discharge surface treatment to form a thick coat, which was difficult for the coating formed by the conventional in-liquid pulsed electric discharge treatment. It is another object of the present invention to provide an electrode for electric discharge surface treatment, a method of electric discharge surface treatment, and an apparatus for electric discharge surface treatment to form a high quality coat in the coating by the in-liquid pulsed electric discharge treatment.

DISCLOSURE OF THE INVENTION

The electrode for electric discharge surface treatment according to the present invention is a green compact made by molding metallic powders or metallic compound powders and used for electric discharge surface treatment in which a pulsed electric discharge is generated between the electrode and a work in a dielectric fluid to form by the electric discharge energy on the surface of the work a coat of a material of the electrode or of a substance that is generated by a reaction of the electrode due to the electric discharge energy, wherein the electrode contains 40 volume % or more metallic material that is not carbonized or is hard to be carbonized.

According to the present invention, it is possible to form a thick coat stably with the in-liquid pulsed electric discharge treatment, as the metallic material that remains in the coat as the metal without becoming carbide during the in-liquid pulsed electric discharge treatment, because the electrode contains materials that are hard to carbonize in a range described above.

BEST MODE FOR CARRYING OUT THE INVENTION

The present invention is explained now with reference to accompanying drawings to explain in greater detail. Meanwhile, the present invention is not to be limited to the explanation given below and may be modified appropriately without departing from the scope of the present invention. In the accompanying drawings, each component is drawn not to the scale to facilitate understanding of the drawings.

First Embodiment

Figure 1:
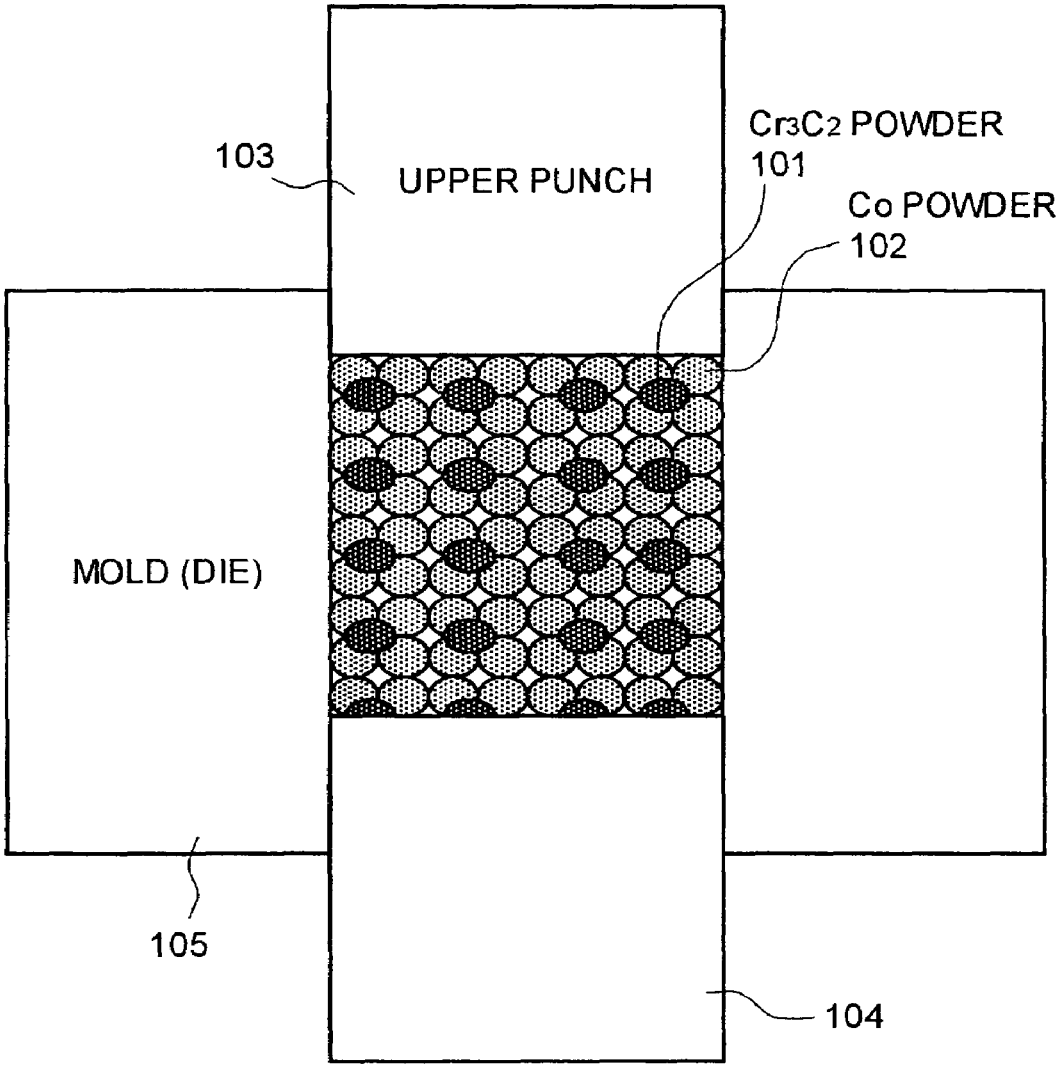
FIG. 1 illustrates a cross-section of an electrode for electric discharge surface treatment and a concept of a manufacturing method of the electrode according to a first embodiment of the present invention.

FIG. 1 illustrates a cross-section of an electrode for electric discharge surface treatment and a concept of a manufacturing method of the electrode according to a first embodiment of the present invention. As shown in FIG. 1, a mixture of a $Cr_3C_2$ (chromium carbide) powder 101 and a Co (cobalt) powder 102 is filled in a space between an upper punch 103 of a mold, a lower punch 104 of the mold, and a die 105 of the mold. A green compact is formed by compression molding the mixture. The green compact thus obtained is used as an electrode for electric discharge in the electric discharge surface machining.

For manufacturing of the electrode, as previously described, forming a hard coat, especially forming the hard coat at temperature close to room temperature, has conventionally been focused on in electric discharge surface machining, and forming a hard carbide-based coat is the current state of the art (for example, such a technology is disclosed in Japanese Patent Application No. 2001-23640). In the technology of forming the carbide-based coat, although it is possible to form a closely packed coat uniformly, there is a problem that the coat cannot be made thicker than several tens of μm as described previously.

However, according to experiments by the inventors of the present invention, it was found that the coat can be made thicker by adding materials that do not form carbides or do not form carbides easily to materials of the electrode. Conventionally, materials that are more likely to form carbides are contained in a large proportion. For example, if the electrode contains a material such as Ti, the coat is formed with a hard carbide of TiC (titanium carbide) as a result of a chemical reaction caused by an electric discharge in an oil. As the surface treatment proceeds, the material of the surface of a work changes from steel (if processed on a piece of steel) to TiC, which is a ceramics, and characteristics such as heat conductivity and melting point change corresponding to the change of the material. However, by adding to the electrode the materials that do not form carbides or do not form carbides easily, a phenomenon that some of the materials remain as metals in the coat, not completely becoming carbides, was noticed. And it was found that selection of the materials for the electrode plays a significant role in the formation of a thicker coat. In this case, satisfying hardness, preciseness, and uniformity is a precondition to form the thick coat.

Figure 2:
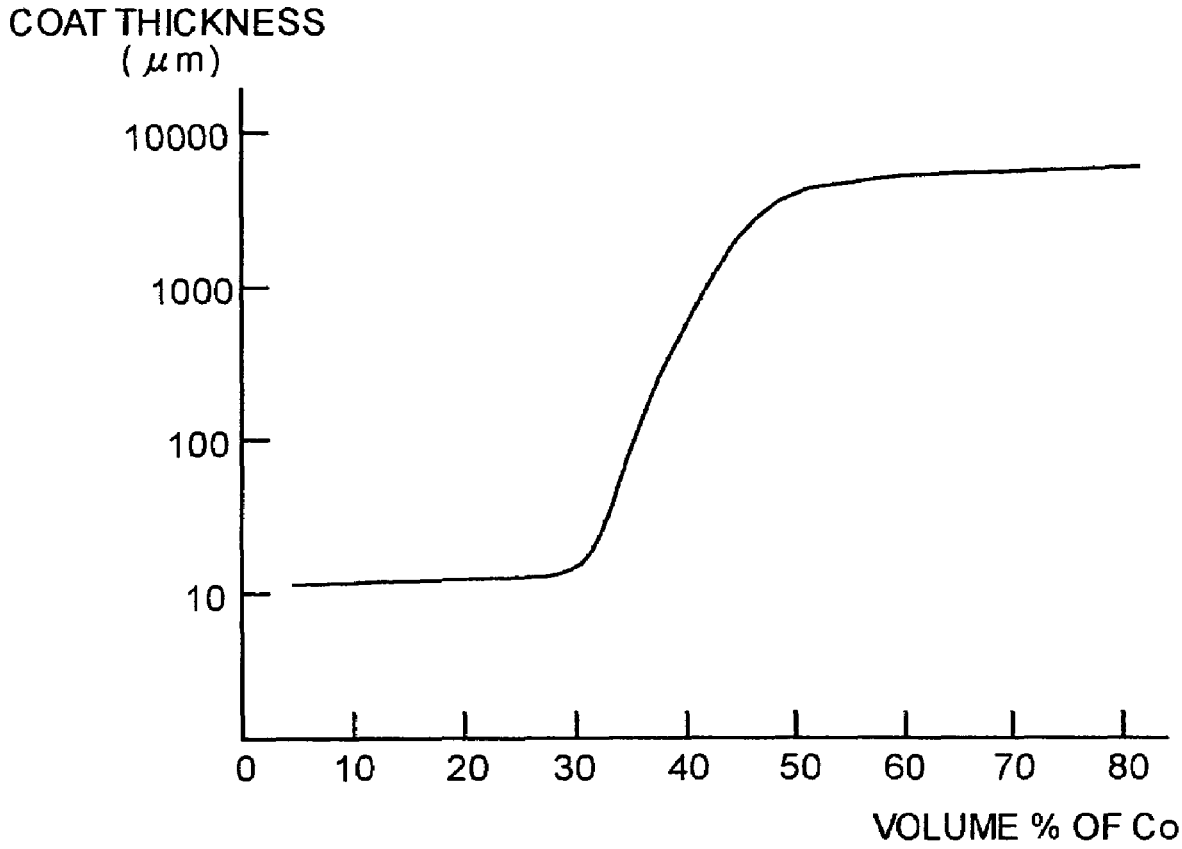
FIG. 2 is a characteristic plot that indicates relationship between a coat thickness and a volume percentage of Co.
Figure 3:
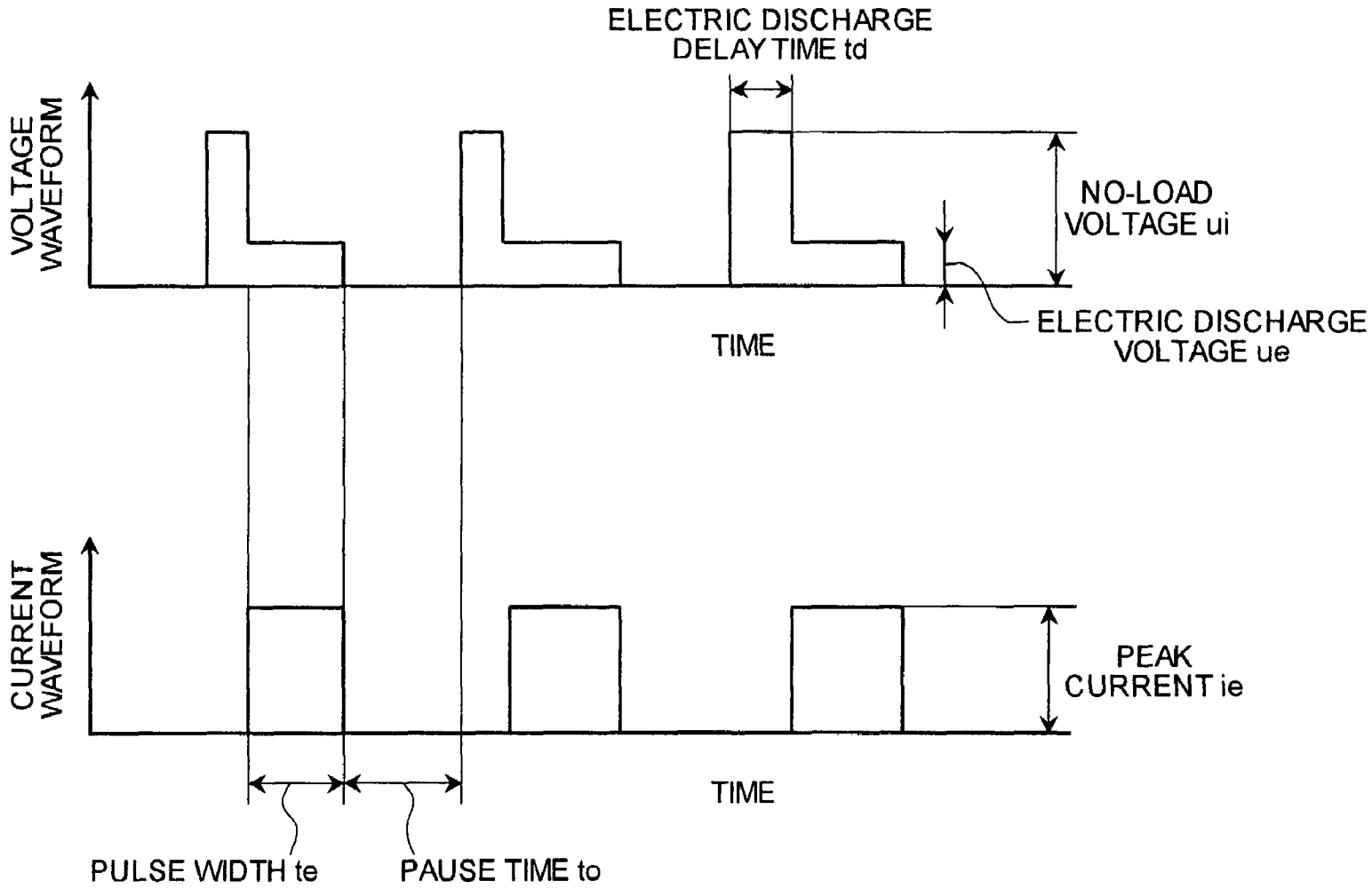
FIG. 3 is a plot of voltage and current waveforms at the electrode.

As shown in FIG. 1, when an electrode is made by compression molding a mixture of $Cr_3C_2$ (chromium carbide), which is a carbide, and Co (cobalt), which is a material hard to form a carbide, and then by heating to increase the strength of the electrode, an aptness to form a thick coat varies by changing an amount of Co, which do not form a carbide easily. FIG. 2 illustrates this fact. The pressure of the compression mold was set to about 100 megapascals (MPa) and the heating temperature was changed in a range of 400 degrees to 800 degrees Celsius (° C.) during manufacturing the electrode. The heating temperature was set higher when $Cr_3C_2$ (chromium carbide) content is higher, and was set lower when Co (cobalt) content is higher. This is because if $Cr_3C_2$ (chromium carbide) content is higher, the electrode tends to become weak and crumbles easily if the heating temperature is low. On the other hand, if Co (cobalt) content is higher, the electrode tends to become strong even if the heating temperature is low. When pressing, a small amount (2% to 3% by weight) of a wax was mixed with the powder to be pressed to obtain better formability. The wax gets removed during the heating. The powder of Cr3C2 (chromium carbide) having a grain diameter of the order of 3 μm to 6 μm was used, and the powder of Co (cobalt) having a grain diameter of the order of 4 μm to 6 μm was used. The material that became the base was Cr3C2 (chromium carbide). An electric discharge pulse that was applied had a waveform as shown in FIG. 3, that is, a waveform having a peak current ie=10 amperes (A), an electric discharge duration (electric discharge pulse width) te=64 microseconds (μs), and a pause time to=128 μs, and an electrode that had an area of 15 millimeters (mm)×15 mm was used when the coat was formed. The processing time was 15 minutes. The electrode was given negative polarity and a work was given positive polarity. In FIG. 3, the waveform is plotted above the y-axis when the polarities of the electrode and the work are assumed to be negative and positive respectively.

When the coat is formed under such pulse condition, the thickness of the coat formed on the work varies with the volume percentage of Co contained in the electrode. As shown in FIG. 2, the coat thickness, which is about 10 μm when the Co content is low, starts becoming gradually thicker at a point at which the Co content is about 30 volume %, and becomes up to nearly 10000 μm at a point at which the Co content exceeds 50 volume %.

Figure 4:
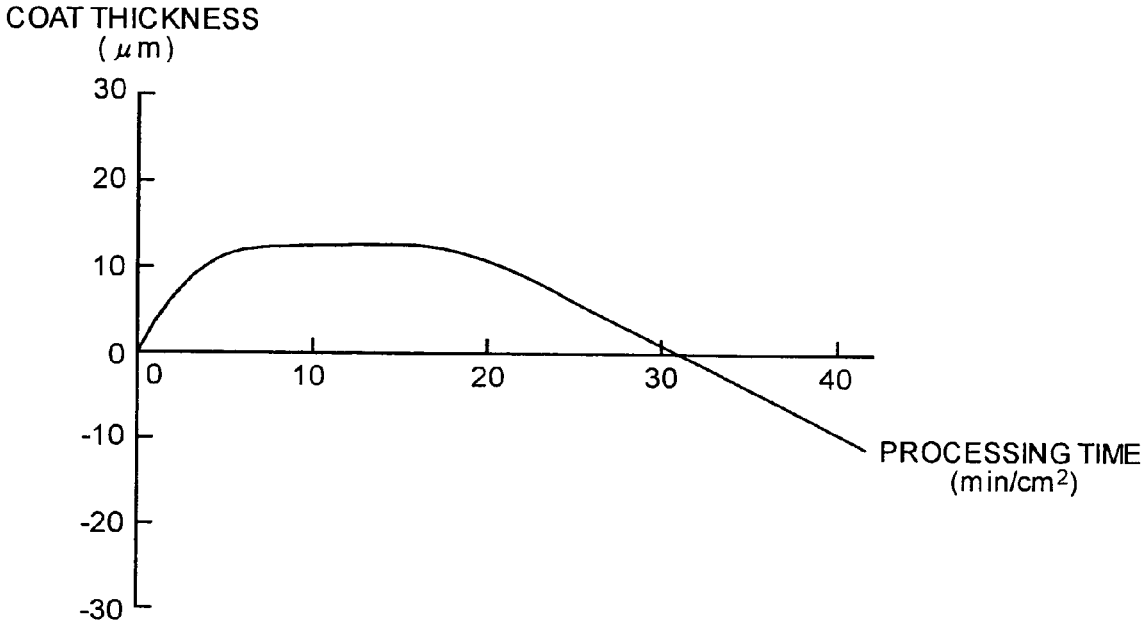
FIG. 4 is a characteristic line plot that indicates relationship between the coat thickness and a processing time.

This fact is described in further detail. When the coat is formed on the work based on the above condition, if the Co content in the electrode is 0%, in other words, if the $Cr_3C_2$ (chromium carbide) content is 100 volume %, the thickness of the coat that can be formed is limited to about 10 μm and the coat cannot be made thicker. Moreover, a relation between the thickness of the coat and the processing time when the electrode does not contain the material that is hard to form a carbide is illustrated in FIG. 4. As shown in FIG. 4, in an early stage of the processing, the coat grows thicker as the processing time increases; however, the thickness of the coat does not increase after a certain point (approximately 5 min/cm$^2$). After such point, the coat thickness does not grow for a while, but if the processing is continued until a certain time (about 20 min/cm$^2$), the coat thickness starts decreasing this time, and finally the height of the coat becomes minus, or hollow. However, the coat exists even though the coat looks hollow and the thickness itself is about 10 μm, which is almost the same as when the coat is processed in an appropriate time. Consequently, the processing time between 5 minutes to 20 minutes is considered to be the appropriate time.

Figure 5:
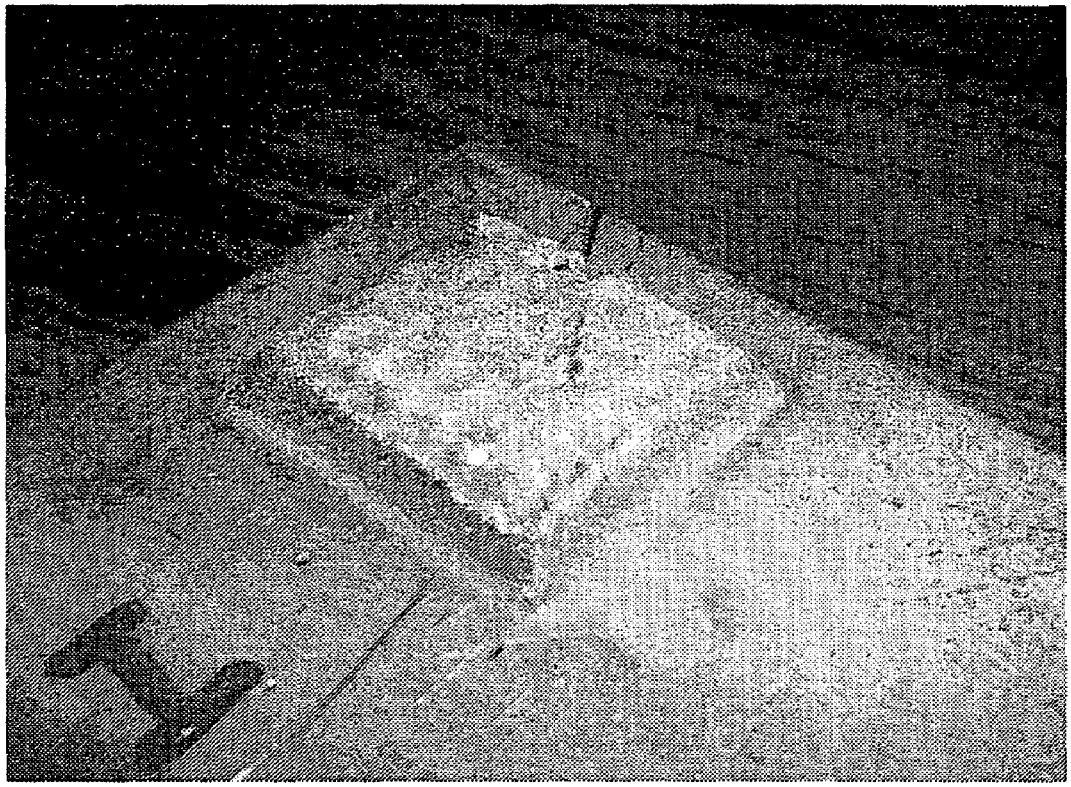
FIG. 5 is a photograph of an example of the coat that is formed when the electrode contains 70 volume % of Co.

Referring to FIG. 2 again, it can be found that as the content of Co that is a material hard to form a carbide increases in the electrode, the coat becomes possible to be made thick, and when the Co content in the electrode exceeds 30 volume %, the thickness of the coat increases, and when the Co content exceeds 40 volume %, a thick coat becomes more likely to be formed stably. Although the coat thickness in the plot in FIG. 2 seems to be smoothly increasing from the point at which the Co content is 30 volume %, the plotted values are mean values of several experimental results, and actually, when the Co content is of the order of 30 volume %, the formation of the coat is unstable, sometimes causing cases that the coat does not grow high and thick, or even if the coat grows high and thick, the strength of the coat is low, in other words, the coat can be removed if it is scraped with a piece of metal and the like. Therefore, it is preferable that the Co content is higher than 50 volume %. Thus, it becomes possible to form a thicker coat that contains an uncarbonized metal by increasing the material that remains as a metal in the coat, and it becomes easy to form the thicker coat stably. Volume percentage here signifies a proportion that is the value of a weight of the powder divided by a density of each material, and is the ratio of the volume of the material to the volume of the whole material of the powder. A photograph of the coat that was formed when the Co content in the electrode was 70 volume % is shown in FIG. 5. The photograph exemplifies the formation of the thick coat. In the photograph shown in FIG. 5, the coat that was formed had a thickness of the order of 2 mm. The coat was formed in 15 minutes of a processing time, and it is possible to make the coat thicker if the processing time is extended.

Thus, a coat can be stably formed on a surface of a work with electric discharge surface treatment, provided that an electrode is used that contains more than 40 volume % of materials such as Co that are not carbonized or are hard to be carbonized.

While a case of Co (cobalt) as the material that is hard to form a carbide has been explained above, because Ni (nickel), Fe (iron) and the like are also such materials that produce similar results, even they can be suitably used in the present invention.

Furthermore, a thick coat here signifies a closely packed coat that has a metallic luster in an internal structure (generally an outermost surface has surface roughness and seems rough having no luster since the coat is formed by means of the pulsed electric discharge). Even when the amount of the material that is hard to form a carbide such as Co (cobalt) is small, a deposition accumulates high if the electrode is made low in strength. However, such a deposition is not a closely packed coat but a coat that can easily be removed if it is scraped with a piece of metal and the like. The deposition that is described in the patent literature 1 mentioned previously and the like is not a closely packed coat but is a coat that can easily be removed if the coat is scraped with a piece of metal and the like.

Moreover, although a case of the electrode has been explained above that is manufactured by compression molding and heating the powder of $Cr_3C_2$ (chromium carbide) and Co, there may be cases in which the green compact obtained by merely compression molding can be used as the electrode. However, to form a closely packed coat, the electrode must be neither too hard nor too soft but should have a proper hardness. Generally, a heating treatment is required. Heating the green compact enables to maintain the form and leads to solidification. The hardness of the electrode has a correlation with the bond strength of the powder of the electrode materials, and relates to the amount of the electrode materials to be provided to the work during the electric discharge. Because the bond strength of the electrode materials is high when the hardness of the electrode is high, only a small amount of the electrode materials is released even if the electric discharge is generated, and it is impossible to form a coat satisfactorily. Conversely, because the bond strength of the electrode materials is low when the hardness of the electrode is low, a large amount of the materials is released when the electric discharge is generated. And if the amount released is too much, it is impossible to form a closely packed coat since the energy of the pulsed electric discharge is insufficient to melt the materials. When ingredients of a powder are the same, parameters that affect the hardness of the electrode, or the bond condition of the electrode materials, are the pressure of a press and the heating temperature. While about 100 MPa is considered in this embodiment as an example of the pressure of the press, if the heating temperature is low, about the same degree of hardness can be obtained by applying a higher pressure. Conversely, it is found that it is necessary to set the heating temperature relatively high if the pressure of the press is low. This fact applies not only to this embodiment but also to other embodiments of the present invention.

Furthermore, while the experimental results under one set of conditions as an example of the electric discharge are described in this embodiment, it is needless to be mention that the similar results can be obtained also under other conditions, although the coat thickness and the like may differ. This fact applies not only to this embodiment but also to the other embodiments of the present invention.

Figure 6:
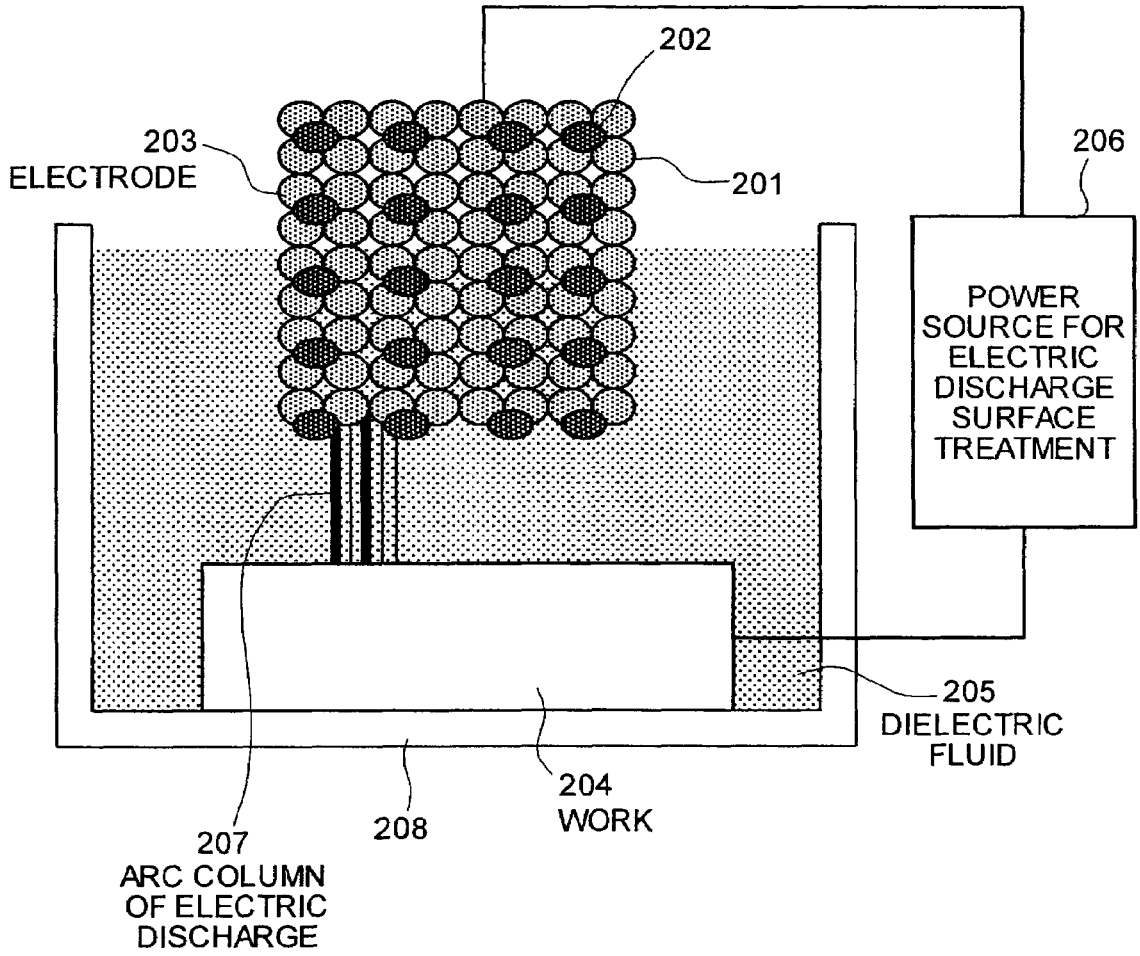
FIG. 6 is a schematic of a configuration of an example of an apparatus for electric discharge surface treatment according to the present invention.

FIG. 6 is a schematic of a configuration of an apparatus for electric discharge surface treatment according to the first embodiment of the present invention. As shown in FIG. 6, the apparatus for electric discharge surface treatment according to the embodiment includes an electrode 203, which is the electrode for electric discharge surface treatment described previously, that is formed with a green compact made by compression molding a powder that contains more than 40 volume % of metal that do not form a carbide or is hard to form a carbide, or with a green compact obtained by heat-treating the green compact; a dielectric fluid 205 that is an oil; a dielectric fluid supply unit 208 to immerse the electrode 203 and a work 204 in the dielectric fluid, or to supply the dielectric fluid 205 between the electrode 203 and the work 204; and a power source for electric discharge surface treatment 206 that generates a pulsed electric discharge by applying a voltage between the electrode 203 and the work 204.

The electrode consists of, for example, a $Cr_3C_2$ (chromium carbide) powder 201 and a Co (cobalt) powder 202, and contains, for example, more than 70 volume % Co that is a material hard to form a carbide. Components that do not relate directly to the present invention, such as a driving unit that controls a relative position of the electrode 203 and the work 204, are omitted.

To form a coat on a surface of the work with the apparatus for electric discharge surface treatment, the electrode 203 and the work 204 are placed oppositely in the dielectric fluid 205, and a pulsed electric discharge is generated between the electrode 203 and the work 204 by the power source for electric discharge surface treatment 206, and with an energy of the electric discharge, a coat of the electrode material, or a coat of a substance that is generated by a reaction of the electrode materials is formed on the surface of the work. The electrode is given negative polarity and the work is given positive polarity. An arc column of the electric discharge 207 occurs between the electrode 203 and the work 204 as shown in FIG. 6.

Forming a coat on the work 204 with the apparatus for electric discharge surface treatment described previously enables a stable formation of a thick coat on the work by means of an in-liquid pulsed electric discharge surface treatment.

Second Embodiment

Figure 7:
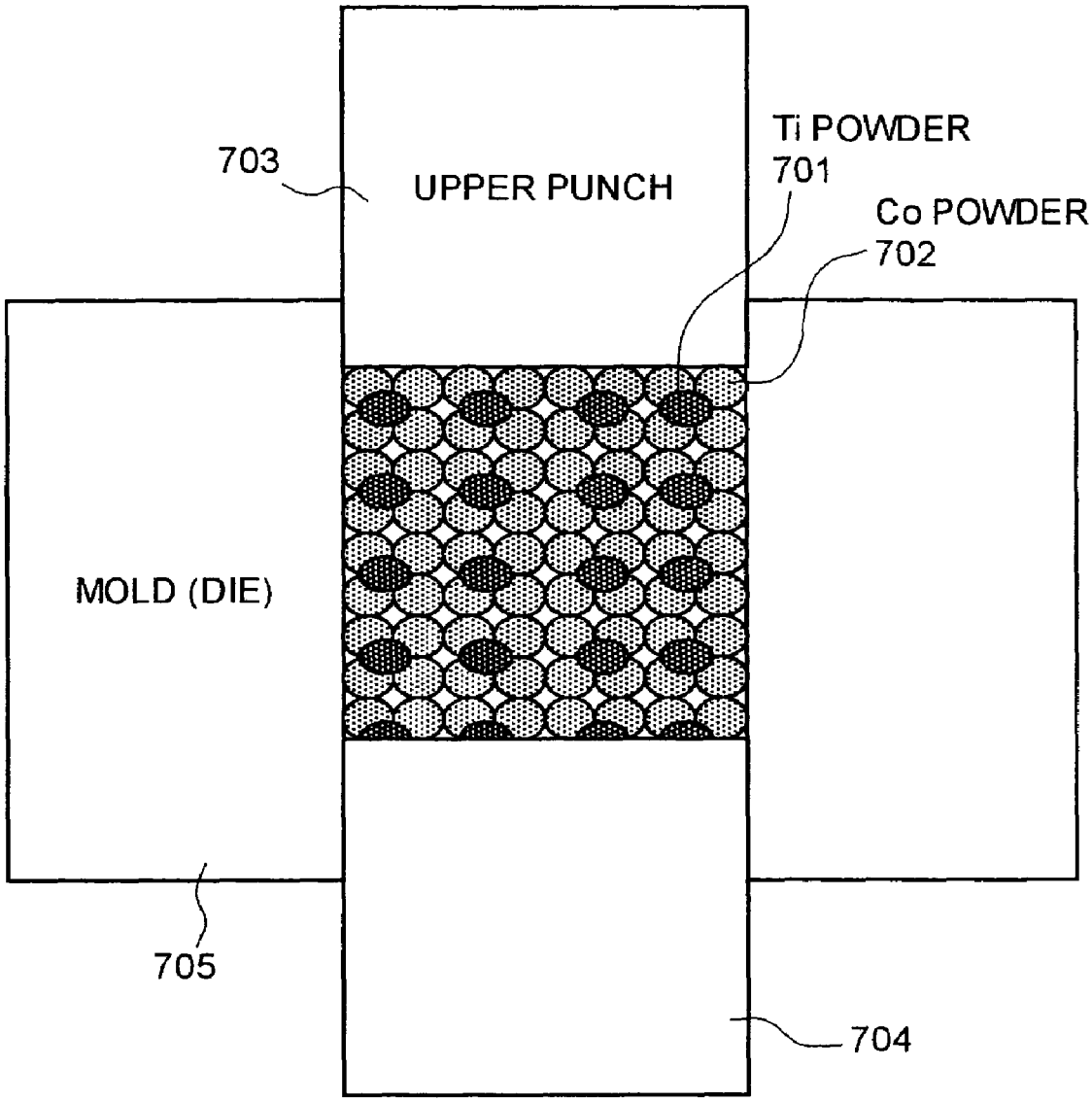
FIG. 7 illustrates a cross-section of an electrode for electric discharge surface treatment and a concept of a manufacturing method of the electrode according to a second embodiment of the present invention.

FIG. 7 illustrates a cross-section of an electrode for electric discharge surface treatment and a concept of a manufacturing method of the electrode according to a second embodiment of the present invention. While a case in which an electrode is formed by compression molding powers with a press has been explained, a method of manufacturing the electrode is not limited to this case. As shown in FIG. 7, a mixture of a Ti (titanium) powder 701 and a Co (cobalt) powder 702 is filled in a space between an upper punch 703 of a mold, a lower punch 704 of the mold, and a die 705 of the mold. A green compact is formed by compression molding the mixture. The green compact thus obtained is used as an electrode for electric discharge in the electric discharge surface machining. The pressure to compression mold the powder was set to about 100 MPa and the heating temperature was changed in a range of 400° C. to 800° C. during manufacturing the electrode.

While characteristics of the formation of the coat with the electrode made of the mixture of the powder of $Cr_3C_2$ (chromium carbide) that is a carbide and the powder of Co (cobalt) that is a metal has been explained in the first embodiment described previously, a case that an electrode made of mixture of a powder of Ti (titanium) that is a metal and a powder of Co (cobalt) is explained in this embodiment. Both Ti (titanium) and Co (cobalt) are metals but there is a difference that Ti (titanium) is an active material and is extremely likely to form TiC (titanium carbide), which is a carbide, in the electric discharge atmosphere in the dielectric fluid that is the oil, while Co (cobalt) is a material that is unlikely to form a carbide.

In the second embodiment, the condition of the formation of the coat when the Co (cobalt) powder content in the electrode was changed by gradually increasing the amount from a state that the percentage of Ti (titanium) powder content in the electrode is 100 volume %, or equivalently, Co in the electrode is 0 volume %, was examined in a manner similar to that in the first embodiment. The powder of Ti (titanium) having a grain diameter of the order of 3 μm to 4 μm, and a powder of Co (cobalt) having grain diameter of the order of 4 μm to 6 μm were used. Because Ti (titanium) is a viscous material and is difficult to be ground into a fine powder, the Ti powder was obtained by ball-milling a brittle material of $TiH_2$ (titanium hydride) into a powder having a grain diameter of the order of 3 μm to 4 μm, by compression molding the powder, and then by making the compression molded powder release hydrogen by heating.

When the electrode material was 100 volume % Ti (titanium), the coat was made up of TiC (titanium carbide) and the thickness of the coat was of the order of 10 μm. However, it was found that it becomes possible to form a thicker coat as the content of Co, which is the material that is hard to be carbonized, increases, and it becomes easy to form the thick coat stably when the content of Co in the electrode exceeds 40 volume %. Moreover, it was found that the Co content in the electrode should preferably be higher than 50 volume % to form the coat having sufficient thickness. The results are almost the same as the results obtained in the first embodiment. It is inferred that this is because Ti (titanium) in the electrode becomes TiC (titanium carbide), a carbide, in the electric discharge atmosphere in the dielectric fluid that is the oil, and the results come out almost the same as when a carbide is initially mixed. When components of the coat were actually analyzed by X-ray diffraction analysis, a peak that indicates TiC (titanium carbide) existence was observed but a peak that indicates Ti (titanium) existence was not observed.

Consequently, also when an electrode is made of a mixture of a Ti (titanium) powder and a Co (cobalt) powder, it is possible to form a thick coat stably on the surface of a work if an electrode that contains more than 40 volume % of Co (cobalt) powder as a material that is hard to be carbonized or not carbonized, is used.

Moreover, while a case of Co (cobalt) as a material that is hard to form a carbide to be mixed with Ti (titanium) to make the electrode has been explained in the embodiment, because Ni (nickel), Fe (iron) and the like are also such materials that produce similar results, even they can be suitably used in the present invention.

While a case in which an electrode is formed by compression molding power with a press has been explain, a method of manufacturing the electrode is not limited to this case. As long as the electrode manufactured is formed powder, the electrode may be manufactured by methods other than compression molding.

Third Embodiment

Figure 8:
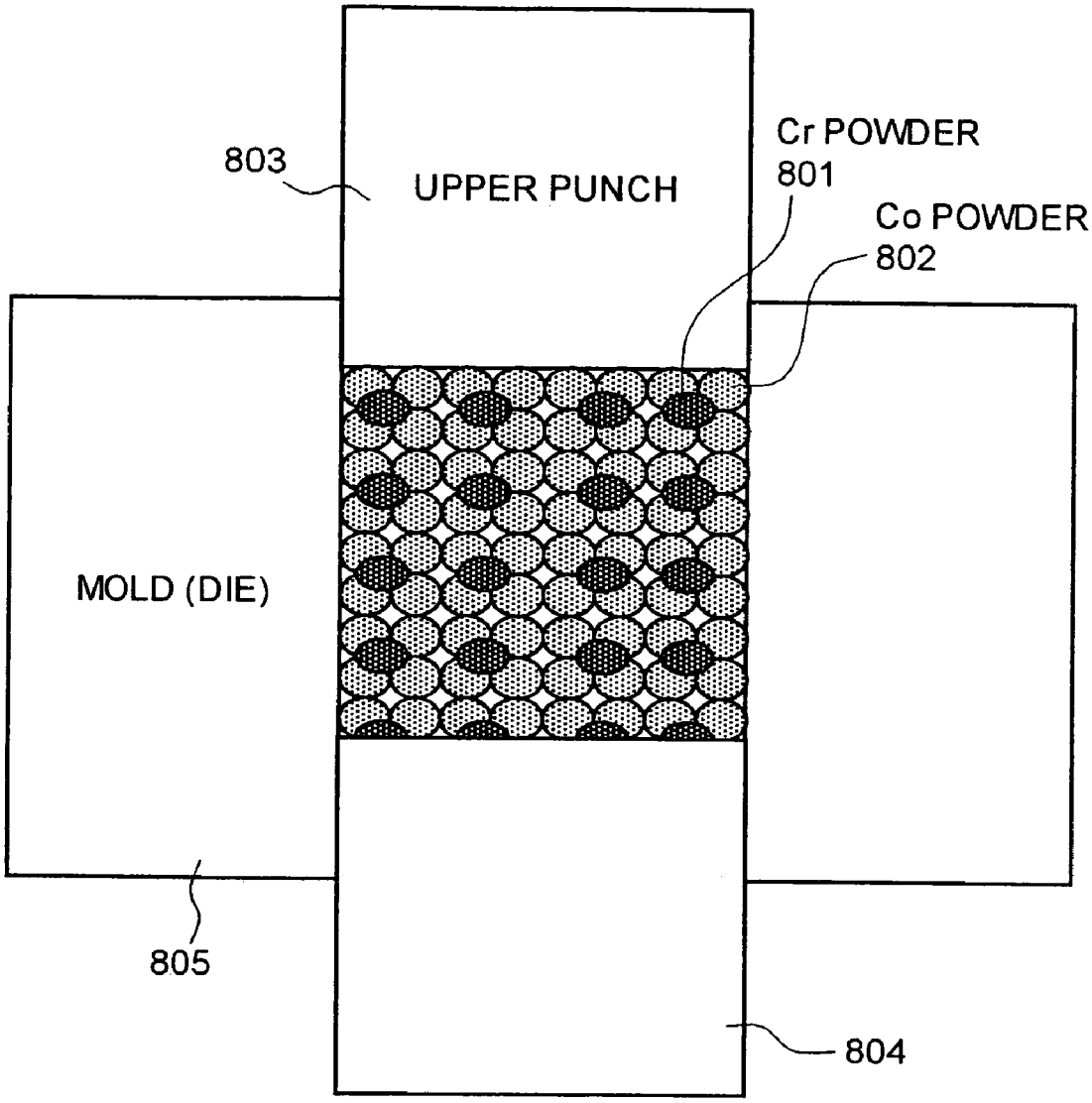
FIG. 8 illustrates a cross-section of an electrode for electric discharge surface treatment and a concept of a manufacturing method of the electrode according to a third embodiment of the present invention.

FIG. 8 illustrates a cross-section of an electrode for electric discharge surface treatment and a concept of a manufacturing method of the electrode according to a third embodiment of the present invention. As shown in FIG. 8, a mixture of a Cr (chromium) powder 801 and a Co (cobalt) powder 802 is filled in a space between an upper punch 803 of a mold, a lower punch 804 of the mold, and a die 805 of the mold. A green compact is formed by compression molding the mixture. The green compact thus obtained is used as an electrode for electric discharge in the electric discharge surface machining. The pressure of the compression mold was set to about 100 MPa and the heating temperature was changed in a range of 400° C. to 800° C. during manufacturing the electrode.

While the formation of the coat when the electrode is made of the powder of Ti (titanium) that is a metal likely to form a carbide and the powder of Co (cobalt) that is a material hard to be carbonized has been explained in the second embodiment, a case of an electrode that is made of a mixture of a powder of Cr (chromium) that is a metal that forms a carbide and a powder of Co (cobalt) is explained in this embodiment.

In the third embodiment, how a coat was formed when the Co (cobalt) powder content in the electrode was changed by gradually increasing the amount from a state that the percentage of Cr (chromium) powder content in the electrode is 100 volume %, or equivalently, Co in the electrode is 0 volume %, was examined in a manner similar to that in the first embodiment. The powder of Cr (chromium) having a grain diameter of the order of 3 μm to 4 μm, and a powder of Co (cobalt) having a grain diameter grain diameter of the order of 4 μm to 6 μm were used.

When the electrode material was 100 volume % Cr (chromium), the thickness of the coat was of the order of 10 μm. When components of the coat were actually analyzed by X-ray diffraction analysis, a peak that indicates Cr3C2 (chromium carbide) existence and a peak that indicates Cr (chromium) were observed. That is to say, although Cr (chromium) is the material that is likely to form a carbide, an aptness to be carbonized is low compared to the material such as Ti (titanium), and if Cr (chromium) is contained in the electrode, a part of it becomes the carbide and a part of it remains as the metal Cr (chromium).

Even when Cr (chromium) is used as the electrode material, it was found that it is possible to form a thicker coat as the content of Co, which is a material hard to be carbonized, increases. However, it was found that the Co content can be in a smaller proportion than when a carbide or a material that is extremely likely to form a carbide is contained in the electrode material like in the first embodiment and the second embodiment, that is, a thick coat becomes more likely to be formed around when the Co content in the electrode exceeds 20 volume %.

Figure 9:
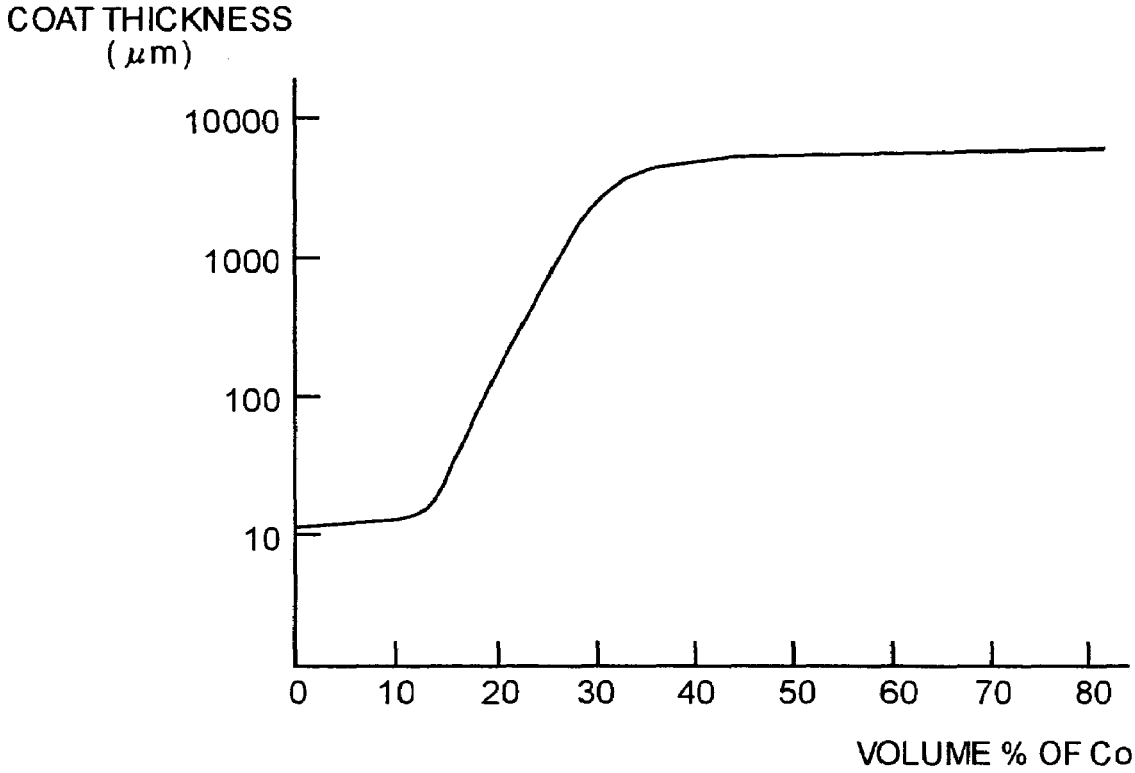
FIG. 9 is a characteristic plot that indicates relationship between a coat thickness and a volume percentage of Co.

A change in the thickness of the coat with a change in the amount of Co content is shown in FIG. 9. The conditions of the pulse of the electric discharge applied were the same as those in the first embodiment and the second embodiment. In other words, a pulse having a peak current ie=10 A, an electric discharge duration (electric discharge pulse width) te=64 μs, and a pause time to=128 μs, was applied, and the electrode that had an area of 15 mm×15 mm was used to form the coat. The electrode was given negative polarity and a work was given positive polarity. A processing time was 15 minutes.

As described previously, an aptness to be carbonized varies even among materials that are likely to form carbides, and materials that are less likely to be carbonized tend to form a thicker coat. It is inferred that this is because the requirement to form the thick coat is to retain a certain proportion for materials that stay behind as metal, i.e., does not become carbide, in materials that form the coat. From the results obtained in the first embodiment to the third embodiment, it can be concluded that the necessary condition to form a thick closely-packed coat is that the proportion of the materials that stay behind as metal in the coat is higher than about 30% in volume.

Moreover, from the experimental results and others explained above, it can be regarded that, although there is no concrete data on an aptness of a metallic material to be carbonized in the electric discharge atmosphere in the dielectric fluid that is the oil, a magnitude of energy required for carbonization can be obtained by referring to the Ellingham diagram. In the Ellingham diagram, it is indicated that Ti (titanium) is extremely likely to be carbonized, and Cr (chromium) is less likely to be carbonized compared to Ti. Moreover, among materials that are likely to form carbides, Ti and Mo (molybdenum) are more likely to be carbonized and Cr (chromium) and Si (silicon) and the like are materials that are relatively less likely to be carbonized. These facts well conform to the actual experimental results.

Consequently, also when an electrode is made of a mixture of a Cr (chromium) powder and a Co (cobalt) powder, it is possible to form a thick coat stably on the surface of a work if an electrode that contains more than 40 volume % of Co (cobalt) powder as a material that is hard to be carbonized or not carbonized, is used. Furthermore, in this case, it is possible to particularly form a thick coat stably on the surface of the work if an electrode that contains more than 20 volume % of Co is used.

Moreover, while a case of Co (cobalt) as a material that is hard to form a carbide to be mixed with Cr (chromium) to make the electrode has been explained above, because Ni (nickel), Fe (iron) and the like are also such materials that produce similar results, even they can be suitably used in the present invention.

While a case in which an electrode is formed by compression molding powers with a press has been explained, a method of manufacturing the electrode is not limited to this case. As long as the electrode manufactured is formed powder, the electrode may be manufactured by methods other than compression molding.

Fourth Embodiment

Figure 10:
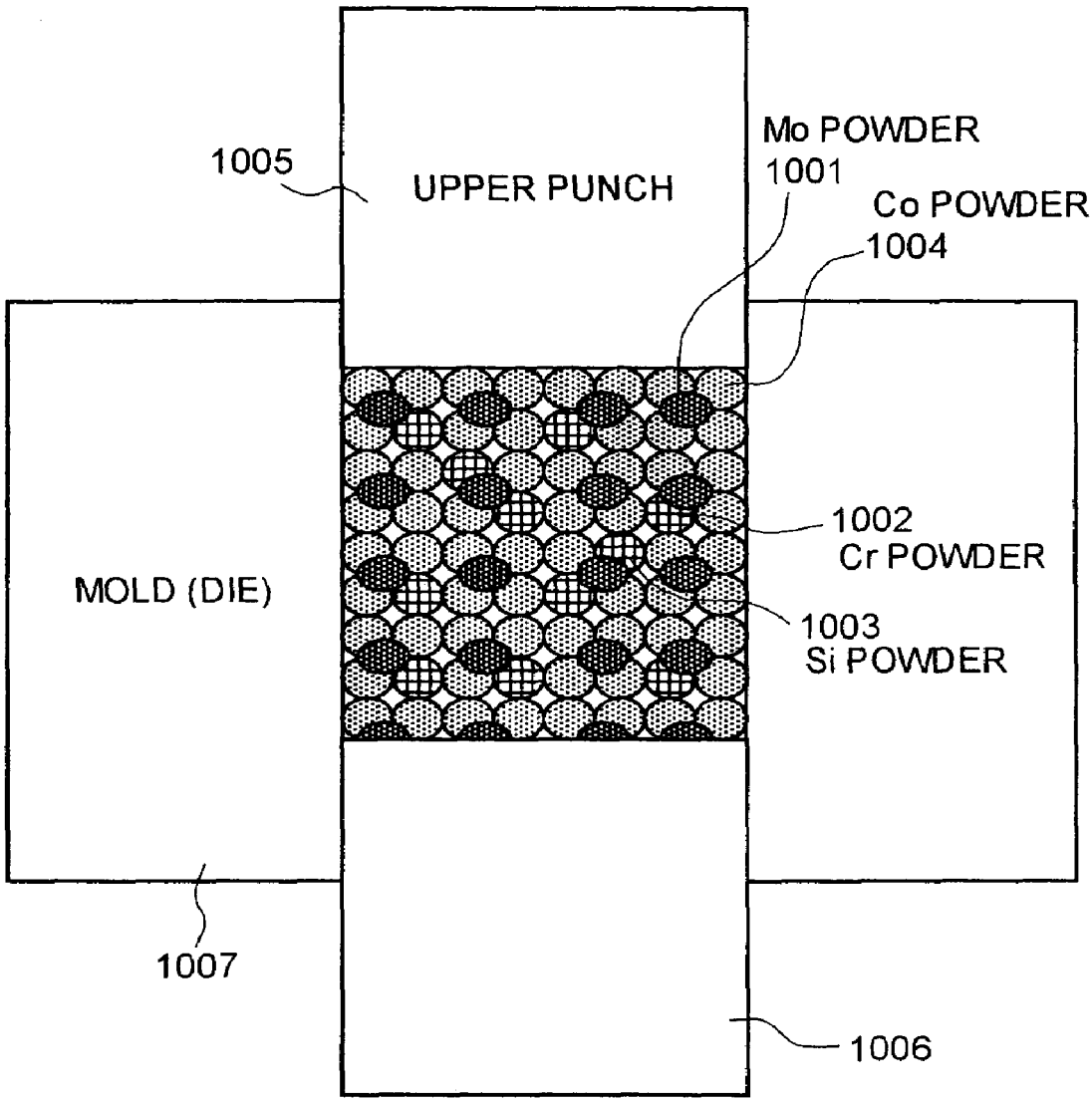
FIG. 10 illustrates a cross-section of an electrode for electric discharge surface treatment and a concept of manufacturing method of the electrode according to a fourth embodiment of the present invention.

FIG. 10 illustrates a cross-section of an electrode for electric discharge surface treatment and a concept of manufacturing method of the electrode according to a fourth embodiment of the present invention. As shown in FIG. 10, a mixture of a Mo (molybdenum) powder 1001, a Cr (chromium) powder 1002, a Si (silicon) 1003 powder, and a Co (cobalt) powder 1004 is filled in a space between an upper punch 1005 of a mold, a lower punch 1006 of the mold, and a die 1007 of the mold. A compound ratio of the mixture is Mo (molybdenum) 28 weight %, Cr (chromium) 17 weight %, Si (silicon) 3 weight %, Co (cobalt) 52 weight %. A volume percentage of Co (cobalt) in this case is about 50%. A green compact is formed by compression molding the mixture. The green compact thus obtained is used as an electrode for the electric discharge in electric discharge surface machining.

The combination and the proportion of Mo (molybdenum) 28 weight %, Cr (chromium) 17 weight %, Si (silicon) 3 weight %, and Co (cobalt) 52 weight % are used to obtain a material that has abrasion resistance in high-temperature environment. The electrode that is composed in such proportion has abrasion resistance because of a hardness of the materials and a lubrication exhibited by $Cr_3C_2$ (chromium carbide) that is formed by oxidation of Cr (chromium) in high-temperature environment.

The pressure of the compression mold was set to about 100 MPa and the heating temperature was set in a range of 400° C. to 800° C. during manufacturing the electrode. When pressing, a small amount (2% to 3% by weight) of a wax was mixed with the powder to be pressed to obtain better formability. The wax gets removed during the heating. A powder of each material having a grain diameter of the order of 2 μm to 6 μm was used. The conditions that were used for the pulse of the electric discharge were a peak current ie=10 A, an electric discharge duration (electric discharge pulse width) te=64 μs, and a pause time to=128 μs, and an electrode having an area of 15 mm×15 mm was used to form the coat. The electrode was given negative polarity and a work was given positive polarity.

With the electrode that is made as described above, an apparatus for electric discharge surface treatment similar to the apparatus in FIG. 6 can be composed. And when the coat is formed on the surface of the work by means of a pulsed electric discharge generated by the apparatus for electric discharge surface treatment, it is possible to form a thick coat on a work material without causing a strain due to the pulsed electric discharge in a dielectric fluid that is an oil. Furthermore, it was confirmed that the coat formed had abrasion resistance even in high-temperature environment, which means that a thick coat with good quality was formed.

It is possible to obtain the coat that has various functions such as abrasion resistance and the like by forming the coat on the surface of the work by means of in-liquid pulsed electric discharge machining with the electrode that is made with the materials compounded in the proportion described previously. Other such materials include a Stellite that consists of "Cr (chromium) 25 weight %, Ni (nickel) 10 weight %, W (tungsten) 7 weight %, and Co (cobalt) for the rest", or "Cr (chromium) 20 weight %, Ni (nickel) 10 weight %, W (tungsten) 15 weight %, and Co (cobalt) for the rest". Since Stellite has excellent corrosion resistance and high-temperature hardness, it is a material that is usually applied for coating by welding and the like to a part that requires such properties, and is suitable for coating when corrosion resistance and high-temperature hardness are required.

Moreover, nickel based materials compounded in such a proportion of "Cr (chromium) 15 weight %, Fe (iron) 8 weight %, Ni (nickel) for the rest" and "Cr (chromium) 21 weight %, Mo (molybdenum) 9 weight %, Ta (tantalum) 4 weight %, and Ni (nickel) for the rest", and "Cr (chromium) 19 weight %, Ni (nickel) 53 weight %, Mo (molybdenum) 3 weight %, (Cb+Ta) 5 weight %, Ti (titanium) 0.8 weight %, Al (aluminum) 0.6 weight %, Fe (iron) for the rest" and the like are materials that have heat resistance, and are suitable for coating when heat resistance is required.

While a case in which an electrode is formed by compression molding powers with a press has been explained, a method of manufacturing the electrode is not limited to this case. As long as the electrode manufactured is formed powder, the electrode may be manufactured by methods other than compression molding.

Fifth Embodiment

Figure 11:
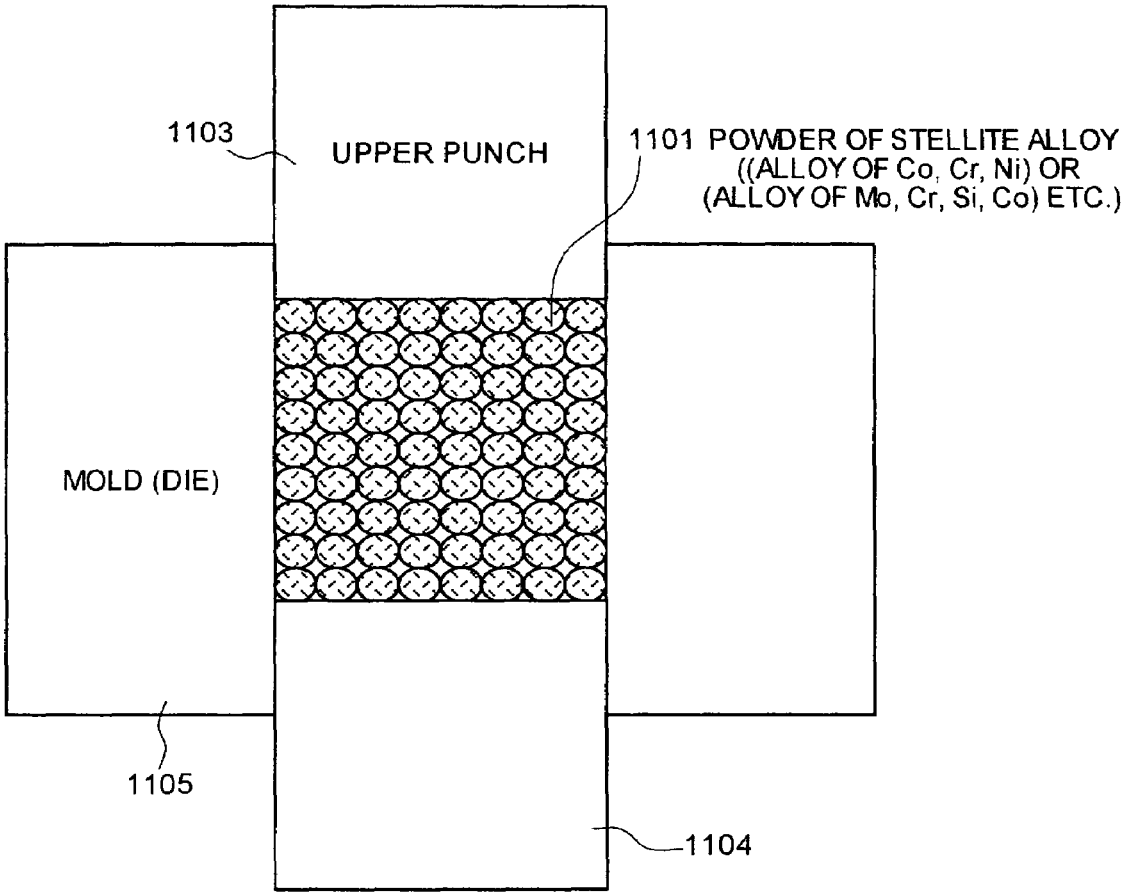
FIG. 11 illustrates a cross-section of an electrode for electric discharge surface treatment and a concept of manufacturing method of the electrode according to a fifth embodiment of the present invention.

The Stellite alloy powder 1101 is a powdered alloy that is made by mixing Co (cobalt), Cr (chromium), Ni (nickel), and the like in a specified proportion. Methods of powdering include, for example, atomization or powdering the alloy with a mill and the like. By either method, each grain in the powder becomes an alloy (Stellite in FIG. 11). The alloy powder is compression molded with the die 1105 and punches 1103, 1104. And then, to enhance strength of the electrode, heating treatment may be carried out depending on a case. The alloy powder that was compounded in a proportion of "Cr (chromium) 20 weight %, Ni (nickel) 10 weight %, W (tungsten) 15 weight %, Co (cobalt) for the rest" was used here. A volume percentage of Co (cobalt) in this case was higher than 40%.

The pressure of the compression mold was set to about 100 MPa and the heating temperature was changed in a range of 600° C. to 800° C. When pressing, a small amount (2% to 3% by weight) of a wax was mixed with the powder to be pressed to obtain better formability. The wax gets removed during the heating. The powder of each material having a grain diameter of the order of 2 μm to 6 μm was used. The conditions that were used for the pulse of the electric discharge were a peak current ie=10 A, an electric discharge duration (electric discharge pulse width) te=64 μs, and a pause time to=128 μs, and an electrode having an area of 15 mm×15 mm was used to form the coat. The electrode was given negative polarity and a work was given positive polarity.

Figure 12:
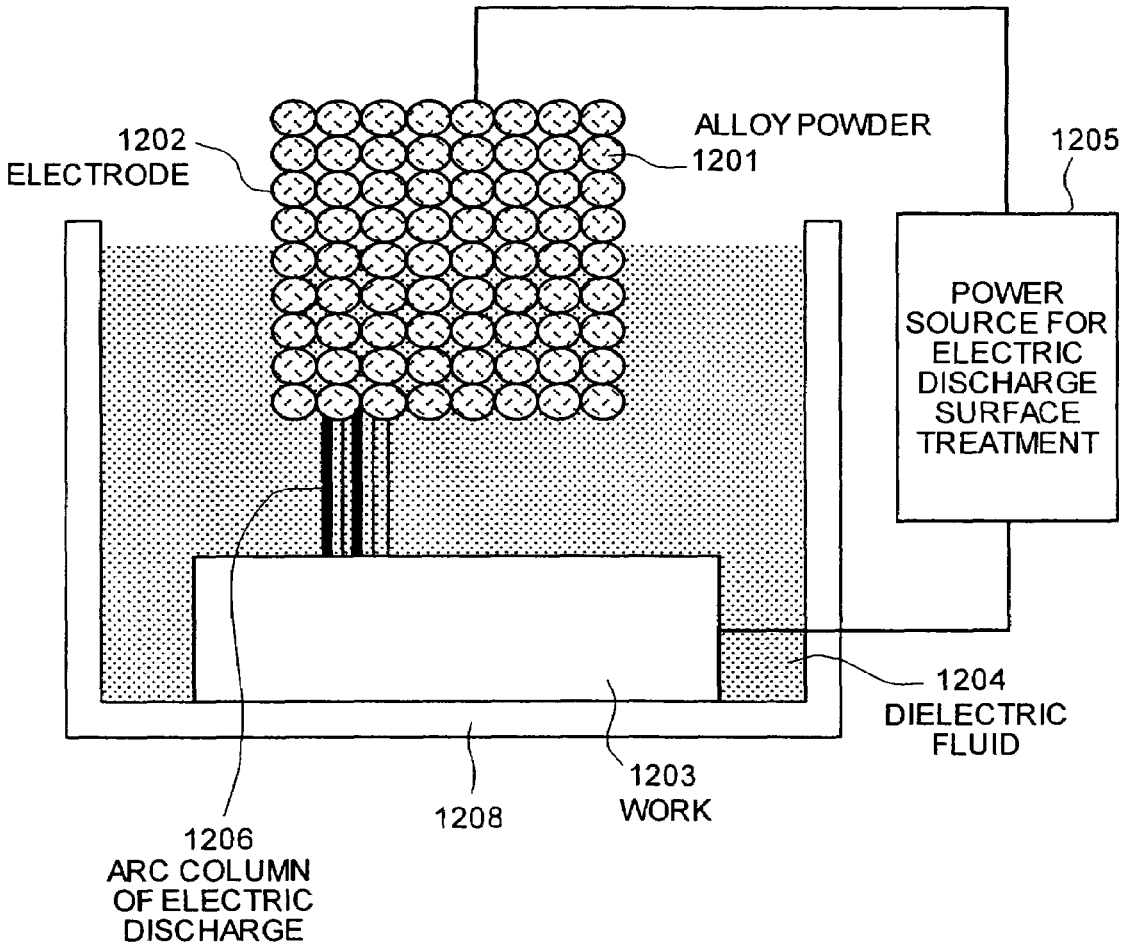
FIG. 12 is a schematic of a configuration of an example of an apparatus for electric discharge surface treatment according to the present invention.

A schematic of configuration of an apparatus for electric discharge surface treatment according to the embodiment using the electrode manufactured as described above is shown in FIG. 12. As shown in FIG. 12, the apparatus for electric discharge surface treatment includes an electrode 1202 that is made of the powder of the alloy compounded in the proportion described previously; a dielectric fluid 1204 that is an oil; a dielectric fluid supply unit 1208 to immerse the electrode 1202 and a work 1203 in the dielectric fluid, or to supply the dielectric fluid 1204 between the electrode 1202 and the work 1203; and a power source for electric discharge surface treatment 1205 that generates a pulsed electric discharge by applying a voltage between the electrode 1202 and the work 1203. The electrode is composed of an alloy powder 1201. Components that do not relate directly to the present invention, such as a driving unit that controls a relative position of the power source for electric discharge surface treatment 1205 and the work 1203, are omitted.

To form a coat on a surface of the work with the apparatus for electric discharge surface treatment, the electrode 1202 and the work 1203 are placed oppositely in the dielectric fluid 1204, and a pulsed electric discharge is generated between the electrode 1202 and the work 1203 by the power source for electric discharge surface treatment 1205, and with an energy of the electric discharge, a coat of the electrode material, or a coat of a substance that is generated by a reaction of the electrode materials is formed on the surface of the work. The electrode is given negative polarity and the work is given positive polarity. An arc column of the electric discharge 1206 occurs between the electrode 1202 and the work 1203 as shown in FIG. 12.

The electrode material is transferred onto the work each time the electric discharge is generated. Although the electrode material is made of a powder, the powder is the alloy made into powder, therefore, the material is homogeneous, and there is no variation in the material when it is transferred onto the electrode 1202. Consequently, it is possible to form a coat with good quality without a compositional variation caused by the nouniformity in the electrode material.

When the electrode of specified composition is made by mixing powders of each material, a problem that a performance of a uniform material cannot be obtained may arise because of the mixture of the powders being nonuniform. In the research conducted by the inventors of the present invention, it was found that when an electrode of a specified composition is made by mixing powders of each material, it is quite difficult to make a mixture completely uniform as more than one kind of powder are mixed, and therefore, compositional variation occurs between individual electrodes or even in one electrode depending on a part. An electrode that contains a material that is likely to form a carbide is more susceptible to this fact. For example, like an alloy described later, if materials that are likely to form carbides such as Mo (molybdenum) and Ti (titanium) are unevenly contained in the electrode, it becomes difficult for only a part that contains such materials to form a thick coat. Therefore, there is a problem that the coat becomes nonuniform not only in the composition but also in a thickness.

However, as described in the embodiment, by making the electrode with the powder that is obtained by powdering an alloy material composed of several elements in a specified proportion, it becomes possible to eliminate the compositional variation in the electrode. And by electric discharge surface machining with the electrode, it becomes possible to form a thick coat stably on a surface of a work, and to make the composition of the coat uniform.

Thus, by forming the coat on the work 1203 by means of the apparatus for electric discharge surface treatment with the electrode described previously, it is possible to form a compositionally uniform thick coat stably on a surface of the work with in-liquid pulsed electric discharge treatment.

While a material obtained by powdering an alloy composed in a proportion such as, "Cr (chromium) 20 weight %, Ni (nickel) 10 weight %, W (tungsten) 15 weight %, and Co (cobalt) for the rest" has been used in the description above, the alloy to be powdered certainly may be other combinations, and for example, an alloy that is made in such a mixing ratio as "Cr (chromium) 25 weight %, Ni (nickel) 10 weight %, W (tungsten) 7 weight %, and Co (cobalt) for the rest" can be used. Moreover, alloys that are made in mixing ratios such as "Mo (molybdenum) 28 weight %, Cr (chromium) 17 weight %, Si (silicon) 3 weight %, and Co (cobalt) for the rest", "Cr (chromium) 15 weight %, Fe (iron) 8 weight %, and Ni (nickel) for the rest", "Cr (chromium) 21 weight %, Mo (molybdenum) 9 weight %, Ta (tantalum) 4 weight %, and Ni (nickel) for the rest", and "Cr (chromium) 19 weight %, Ni (nickel) 53 weight %, Mo (molybdenum) 3 weight %, (Cb+Ta) 5 weight %, Ti (titanium) 0.8 weight %, Al (aluminum) 0.6 weight %, and Fe (iron) for the rest" can also be used. However, because a property of the material, such as the hardness, may be different if the mixing ratio of the alloy is different, a formability of the electrode and a condition of the coat vary to an extent.

If the hardness of an electrode material is high, it is difficult to mold a powder by pressing. In addition, to increase strength of the electrode by heating treatment, it is necessary to give some contrivance such as setting the heating temperature relatively high. For example, an alloy that is compounded in an alloy mixing ratio of "Cr (chromium) 25 weight %, Ni (nickel) 10 weight %, W (tungsten) 7 weight %, and Co (cobalt) for the rest" is relatively soft, and an alloy that is compounded in a mixing ratio of "Mo (molybdenum) 28 weight %, Cr (chromium) 17 weight %, Si (silicon) 3 weight %, and Co (cobalt) for the rest" is relatively hard material. When heat-treating the electrode, it is necessary to set the heating temperature about 100° C. higher in a case of the former alloy than in a case of the latter alloy on average to obtain strength required to the electrode.

Regarding the likelihood of forming a thick coat, as explained in the first embodiment to the fourth embodiment, it becomes easier to form a thick coat as the content of the metal in the coat increases. Regarding materials that compose an alloy powder, which is a component of the electrode, as a content of Co (cobalt), Ni (nickel), or Fe (iron) that are materials unlikely to form carbides increases, it becomes easier to form a closely packed thick coat.

By conducting tests with several kinds of alloy powder, it was found that it becomes easier to form a thick coat stably if the content of a material that is hard to form a carbide or does not form a carbide in the electrode exceeds 40 volume %. And it was found that it is preferable that the Co content in the electrode is higher than 50 volume % to form the thick coat of sufficient thickness. Although it is difficult to define a volume percentage of a material in an alloy, a proportion that is a value of a weight of each powder divided by a density of each material is regarded as the volume percentage here. It is needless to mention that the volume percentage becomes almost the same as a weight percentage if specific gravities of original materials that compose the alloy are close to each other.

Furthermore, even if a material that forms a carbide is used as a component of the alloy besides Co (cobalt), Ni (nickel), and Fe (iron), if the material is relatively unlikely to form a carbide among the materials, a metallic component other than Co (cobalt), Ni (nickel), and Fe (iron) is to be contained in the coat, and therefore, it is possible to form a closely packed thick coat even with low proportions of Co (cobalt), Ni (nickel), and Fe (iron).

It was found that when an alloy made from two elements of Cr (chromium) and Co (cobalt) is used, it becomes easy to form a thick coat when Co content in the electrode exceeds 20 volume %. A volume percentage of Co here is ((weight % of Co)/(specific gravity of Co)+(((weight % of Cr)/(specific gravity of Cr))+((weight % of Co)/(specific gravity of Co))) as described previously. Although Cr (chromium) is a material that forms a carbide, it is less likely to form a carbide compared to an active material such as Ti. When components of the coat were actually analyzed by X-ray diffraction analysis, XPS (X-ray Photoelectron Spectroscopy) and the like, a peak that indicates Cr3C2 (chromium carbide) existence and a data that indicates Cr (chromium) existence were observed. In other words, although Cr (chromium) is a material that is likely to be carbonized, an aptness to be carbonized is low compared to a material such as Ti (titanium), and if Cr (chromium) is contained in the electrode, a part of the content becomes the carbide and a part of the content stays behind as metal Cr (chromium) in the coat. Considering results mentioned above, it is necessary that a proportion of a material that remains as a metal in the coat is higher than about 30% by volume to form a closely packed thick film.

While a case in which an electrode is formed by compression molding powers with a press has been explained, a method of manufacturing the electrode is not limited to this case. As long as the electrode manufactured is formed powder, the electrode may be manufactured by methods other than compression molding.

Sixth Embodiment

Figure 13:
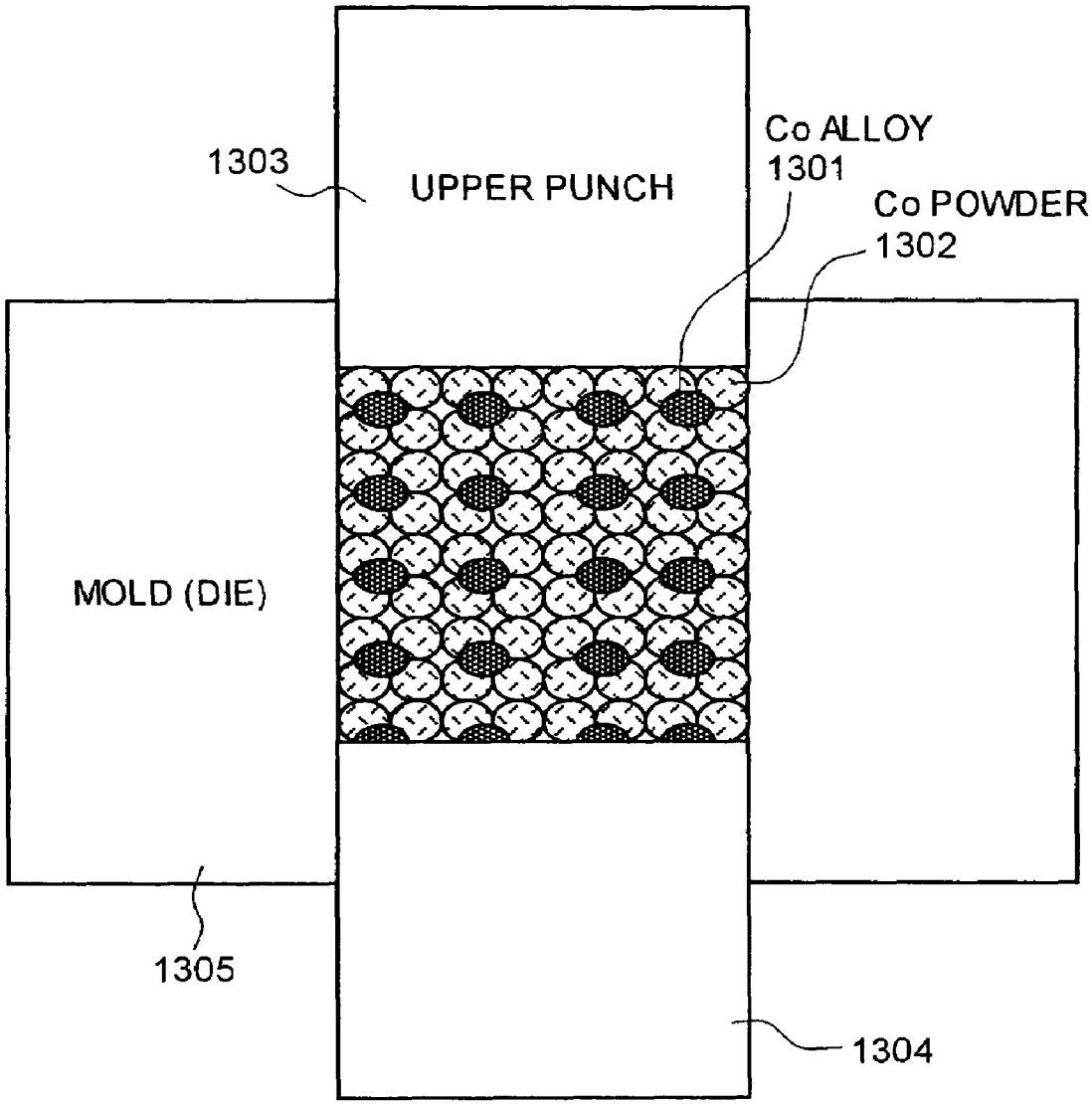
FIG. 13 illustrates a cross-section of an electrode for electric discharge surface treatment and a concept of manufacturing method of the electrode according to a sixth embodiment of the present invention.

FIG. 13 illustrates a cross-section of an electrode for electric discharge surface treatment and a concept of manufacturing method of the electrode according to a sixth embodiment of the present invention. As shown in FIG. 13, a mixture of a Co alloy powder 1301 and a Co (cobalt) powder 1302 is filled in a space between an upper punch 1303 of a mold, a lower punch 1304 of the mold, and a die 1305 of the mold. A green compact is formed by compression molding the mixture. The green compact thus obtained is used as an electrode for electric discharge in electric discharge surface machining. The pressure of the compression mold is set to about 100 MPa and the heating temperature is set in a range of 600° C. to 800° C. during manufacturing the electrode.

The mixing ratio of the Co alloy powder 1301 is "Mo (molybdenum) 28 weight %, Cr (chromium) 17 weight %, Si (silicon) 3 weight %, Co (cobalt) for the rest". The Co alloy powder 1301 is obtained by powdering an alloy material compounded with such a mixing ratio. The Co alloy powder and the Co powder 1302 both having a grain diameter of the order of 2 μm to 6 μm are used. The alloy having such a mixing ratio as "Mo (molybdenum) 28 weight %, Cr (chromium) 17 weight %, Si (silicon) 3 weight %, Co (cobalt) for the rest" is the alloy that is used as a material that requires abrasion resistance in high-temperature environment. The alloy has abrasion resistance because of a hardness of the materials and a lubrication exhibited by $Cr_3C_2$ (chromium carbide) that is formed by oxidation of Cr (chromium) in high-temperature environment. Therefore, with an electrode that contains this alloy powder, it is possible to form a coat that has an excellent abrasion resistance.

However, when the coat is formed in the electric discharge surface treatment, although it is possible to make an electrode only with the alloy powder of the given composition, there are problems that unevenness in quality of the electrode is easy to occur because there is a problem, to some extent, in formability when compression molding with a press due to hardness of the material, and that there may be a case that it is difficult to form a closely packed coat because Mo (molybdenum) that is likely to form a carbide is contained in relatively large proportion.

If there is the problem that is mentioned above, it becomes possible to enhance the likelihood of forming a thick coat by adding more Co (cobalt) powder. When a coat is formed with the electrode that is made of only the alloy powder compounded in the mixing ratio of "Mo (molybdenum) 28 weight %, Cr (chromium) 17 weight %, Si (silicon) 3 weight %, Co (cobalt) for the rest", a void ratio in the coat formed is of the order of 10%. Whereas, when a coat is formed with an electrode that is made of a mixture obtained by adding Co (cobalt) powder in about 20 weight % to the alloy powder compounded in the mixing ratio of "Mo (molybdenum) 28 weight %, Cr (chromium) 17 weight %, Si (silicon) 3 weight %, Co (cobalt) for the rest", a void ratio in the coat can be reduced to about 3% to 4%. Consequently, with the electrode that is made of the mixture obtained by adding Co (cobalt) powder in about 20 weight % to the alloy powder compounded in the mixing ratio of "Mo (molybdenum) 28 weight %, Cr (chromium) 17 weight %, Si (silicon) 3 weight %, Co (cobalt) for the rest", it becomes possible to form a closely packed thick coat having abrasion resistance. Ni or Fe, other than Co, can be used as a material that brings about such effectiveness, and more than one material can be mixed among such materials.

While a case in which an electrode is formed by compression molding powers with a press has been explained, a method of manufacturing the electrode is not limited to this case. As long as the electrode manufactured is formed powder, the electrode may be manufactured by methods other than compression molding.

Seventh Embodiment

Figure 14:
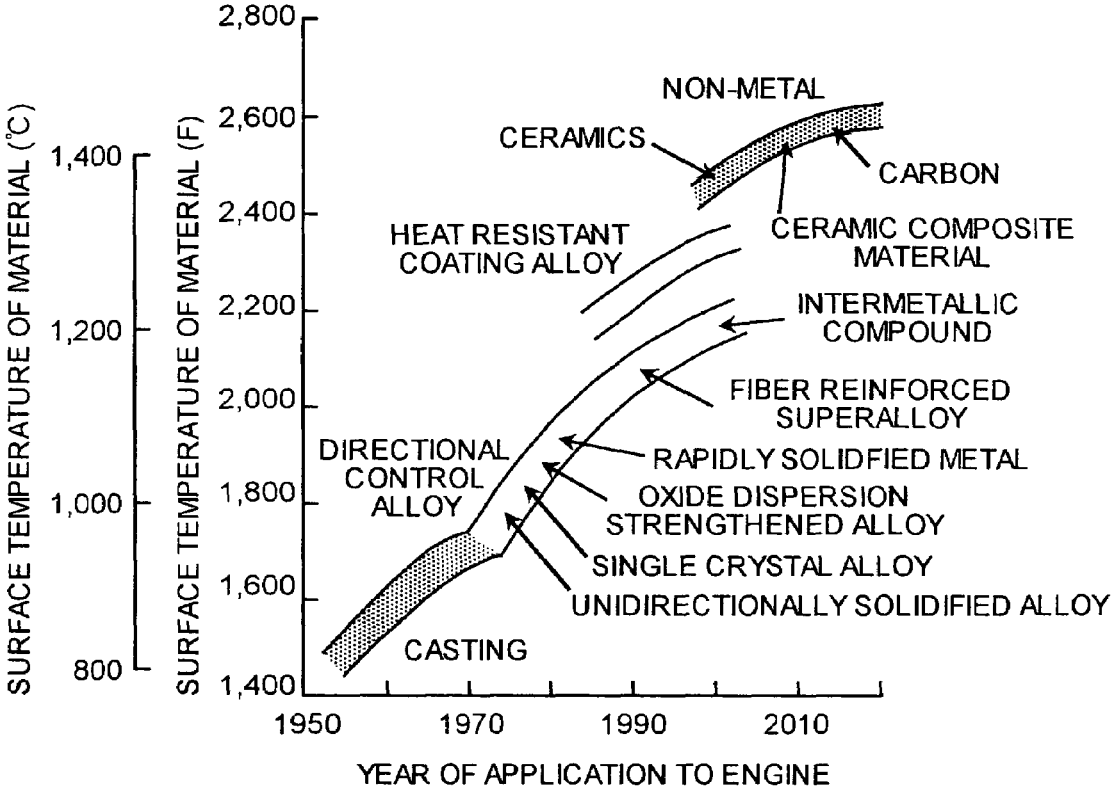
FIG. 14 is an explanatory diagram that indicates a transition of materials applied to aircraft engines.

FIG. 14 is an explanatory diagram that indicates a transition of materials applied to aircraft engines. Because the aircraft engines, for example the engine blades, are used in high-temperature environment, heat-resistant alloys are used as the material applied. An ordinary casting was used before; however, special castings such as a single crystal alloy, a unidirectionally solidified alloy and the like are used now-a-days. Although these materials are heat-resistant materials in high-temperature environment, there is a drawback that it gets easily damaged if a major unevenness in temperature occurs due to entering of heat locally as in the case of the welding. Also when the aircraft engines are considered as a whole, because in most cases, other materials are attached by welding and thermal spray coating there are problems that it gets easily damaged due to concentration of the heat locally, and the yield is low.

As an electric discharge current flows continuously in the welding, a point on the work at which an arc is applied does not shift in a short time and is heated hard. On the other hand, as the electric discharge current is stopped in a short time (a period from about several μs to several tens of μs), in the embodiment of the present invention, there is no concentration of the heat. A period of the pulse width te shown in FIG. 3 is the period that the electric discharge is generated and the electric discharge delay time td and the pause time to are the period that the electric discharge is not generated, in other words, the period that the heat is not applied to the work. Moreover, when one electric discharge pulse is finished, the following electric discharge to be generated is applied on another part; therefore, it can be understood that there is less concentration of the heat compared to welding.

In this embodiment, it is possible to prevent occurrence of the crack by practicing electric discharge surface treatment to form a metallic coat on the single crystal alloy or the unidirectionally solidified alloy, and by dispersing the heat input by means of an in-liquid pulsed electric discharge. Furthermore, it is possible to obtain a thick coat by using an electrode that contains metallic materials that do not form carbides or are hard to form carbides for more than 40 volume %, not by welding or thermal spray coating as conventionally been practiced, and as a result, it is possible to form the thick coat without causing the crack.

While a case in which an electrode is formed by compression molding powers with a press has been explained, a method of manufacturing the electrode is not limited to this case. As long as the electrode manufactured is formed powder, the electrode may be manufactured by methods other than compression molding.

INDUSTRIAL APPLICABILITY

As described above, the electrode for electric discharge surface treatment according to the present invention is suitable for application in a surface treatment related industry that forms a coat on a surface of a workpiece, and is especially suitable for application in the surface treatment related industry that forms a thick coat on a surface of a workpiece.

The invention claimed is:

1. An electrode for electric discharge surface treatment, the electrode is a green compact made by molding metallic powders or metallic compound powders, the green compact being heat treated and used for electric discharge surface treatment in which a pulsed electric discharge is generated between the electrode and a work in a dielectric fluid to form by the electric discharge energy on the surface of the work a coat of a material of the electrode or of a substance that is generated by a reaction of the electrode due to the electric discharge energy, wherein the electrode contains 40 volume % or more Co, Ni, or Fe.

2. An electrode for electric discharge surface treatment, the electrode is a green compact made by molding metallic powders or metallic compound powders, the green compact being heat treated and used for electric discharge surface treatment in which a pulsed electric discharge is generated between the electrode and a work in a dielectric fluid to form by the electric discharge energy on the surface of the work a coat of a material of the electrode or of a substance that is generated by a reaction of the electrode due to the electric discharge energy, wherein the electrode is made by mixing a powder of at least one of Co, Ni, and Fe to a powder of an alloy material that has been alloyed by mixing a plurality of metal elements in a predetermined ratio.

3. The electrode for electric discharge surface treatment according to claim 2, wherein the alloy material contains 40 volume % or more metallic material that is not carbonized or is hard to be carbonized.

4. The electrode for electric discharge surface treatment according to claim 3, wherein the metallic material that is not carbonized or is hard to be carbonized is Co, Ni, or Fe.

5. The electrode for electric discharge surface treatment according to claim 2, wherein the alloy material is one of the following groups: a Co alloy containing Cr, Ni, and W with Co as a main component; a Co alloy containing Mo, Cr, and Si with Co as a main component; an Ni alloy containing Cr, and Fe with Ni as a main component; an Ni alloy containing Cr, Mo and Ta with Ni as a main component; or an Fe alloy containing Cr, Ni, Mo, (Cb +Ta), Ti, and Al with Fe as a main component.

6. A method of electric discharge surface treatment, comprising: generating pulsed electric discharge in a dielectric fluid between a green compact electrode and a work, the electrode being made by molding a metallic powder or metallic compound powders; and forming a coat that contains a carbide and a non-carbonized metallic component in a predetermined ratio based on materials supplied from the green compact electrode on a surface of the work using an energy of the electric discharge, wherein the ratio of the non-carbonized metallic component is 30 volume % or more.

7. The method of electric discharge surface treatment according to claim 6, wherein the electrode is discharged to form the coat on the surface of the work and wherein the electrode contains 40 volume % or more metallic material that is not carbonized or is hard to be carbonized.

8. The method of electric discharge surface treatment according to claim 6, wherein the metallic material that is not carbonized or is hard to be carbonized is Co, Ni, or Fe.

9. The method of electric discharge surface treatment according to claim 6, wherein the material of the work is a directional control alloy.

10. A method of electric discharge surface treatment of using an electrode that is a green compact made by molding metallic powders or metallic compound powders, the green compact being heat treated, for electric discharge surface treatment in which a pulsed electric discharge is generated between the electrode and a work in a dielectric fluid to form by the electric discharge energy on the surface of the work a coat of a material of the electrode or of a substance that is generated by a reaction of the electrode due to the electric discharge energy, wherein the coat is formed by using an electrode made by mixing a powder of at least one of Co, Ni, and Fe to powder of an alloy material that has been alloyed by mixing a plurality of metal elements in a predetermined ratio.

11. The method of electric discharge surface treatment according to claim 10, wherein the material of the work is a directional control alloy.

12. The method of electric discharge surface treatment according to claim 10, wherein the alloy material contains 40 volume % or more metallic material that is not carbonized or is hard to be carbonized.

13. The method of electric discharge surface treatment according to claim 12, wherein the metallic material that is not carbonized or is hard to be carbonized is Co, Ni, or Fe.

14. The method of electric discharge surface treatment according to claim 10, wherein the alloy material is one of the following groups: a Co alloy containing Cr, Ni, and W with Co as a main component; a Co alloy containing Mo, Cr, and Si with Co as a main component; an Ni alloy containing Cr, and Fe with Ni as a main component; an Ni alloy containing Cr, Mo and Ta with Ni as a main component; and an Fe alloy containing Cr, Ni, Mo, (Cb+Ta), Ti, and Al with Fe as a main component.

15. An apparatus for electric discharge surface treatment, comprising:

an electrode of a heat-treated green compact comprising molded powders containing 40 volume % or more Co, Ni, or Fe;

a dielectric fluid supply unit to immerse the electrode and a work in the dielectric fluid or that supplies the dielectric fluid between the electrode and the work; and a power source unit that generates pulsed electric discharge by applying voltage between the electrode and the work.

16. An apparatus for electric discharge surface treatment, comprising:

an electrode of a heat-treated green compact comprising a powder of at least one of Co, Ni, and Fe mixed with a powder of an alloy material that has been alloyed by mixing a plurality of metal elements in a predetermined ratio;

a dielectric fluid supply unit to immerse the electrode and a work in the dielectric fluid or that supplies the dielectric fluid between the electrode and the work; and a power source unit that generates pulsed electric discharge by applying voltage between the electrode and the work.

17. The apparatus for electric discharge surface treatment according to claim 16, wherein the alloy material contains 40 volume % or more metallic material that is not carbonized or is hard to be carbonized.

18. The apparatus for electric discharge surface treatment according to claim 17, wherein the metallic material that is not carbonized or is hard to be carbonized is Co, Ni, or Fe.

19. The apparatus for electric discharge surface treatment according to claim 16, wherein the alloy material is one of the following groups: a Co alloy containing Cr, Ni, and W with Co as a main component; a Co alloy containing Mo, Cr, and Si with Co as a main component; an Ni alloy containing Cr, and Fe with Ni as a main component; an Ni alloy containing Cr, Mo and Ta with Ni as a main component; or an Fe alloy containing Cr, Ni, Mo, (Cb +Ta), Ti, and Al with Fe as a main component.

* * * * *